US007210845B2

(12) United States Patent
Oesch et al.

(10) Patent No.: US 7,210,845 B2
(45) Date of Patent: May 1, 2007

(54) PORTABLE ELECTRONIC INSTRUMENT INCLUDING AT LEAST ONE INPUT/OUTPUT TERMINAL FOR ESTABLISHING A COMMUNICATION WITH AN ELECTRONIC UNIT ARRANGED WITHIN SAID INSTRUMENT

(75) Inventors: Yves Oesch, Neuchâtel (CH); Jean-Daniel Etienne, Les Geneveys-sur-Coffrane (CH); Emil Zellweger, Lommiswil (CH); Yvan Ferri, Lausanne (CH)

(73) Assignee: Asulab SA, Marin (CH)

( * ) Notice: Subject to any disclaimer, the term of this patent is extended or adjusted under 35 U.S.C. 154(b) by 260 days.

(21) Appl. No.: 10/946,882

(22) Filed: Sep. 22, 2004

(65) Prior Publication Data

US 2005/0073806 A1 Apr. 7, 2005

(30) Foreign Application Priority Data

Sep. 23, 2003 (EP) ..... 03021458

(51) Int. Cl.
*G04B 29/00* (2006.01)

(52) U.S. Cl. ..... 368/320; 368/319; 368/321

(58) Field of Classification Search ..... 368/319–321
See application file for complete search history.

(56) References Cited

U.S. PATENT DOCUMENTS

| | | | | |
|---|---|---|---|---|
| 4,043,115 | A * | 8/1977 | Bryceland | 368/69 |
| 4,430,532 | A * | 2/1984 | Matsumoto | 200/52 R |
| 4,536,095 | A * | 8/1985 | Wuthrich et al. | 368/321 |
| 5,043,958 | A * | 8/1991 | Kaelin | 368/321 |
| 5,164,924 | A * | 11/1992 | Saito | 368/320 |
| 5,889,308 | A | 3/1999 | Hong et al. | |
| 6,625,087 | B2 * | 9/2003 | Paratte | 368/69 |
| 2003/0174590 | A1 * | 9/2003 | Arikawa et al. | 368/319 |

FOREIGN PATENT DOCUMENTS

| | | |
|---|---|---|
| EP | 1 134 630 | 9/2001 |
| JP | 111 26 115 | 5/1999 |
| JP | 200 117 5610 | 6/2001 |

* cited by examiner

*Primary Examiner*—Vit Miska
*Assistant Examiner*—Thanh S. Phan
(74) *Attorney, Agent, or Firm*—Sughrue Mion, PLLC

(57) ABSTRACT

There is disclosed a portable electronic instrument (1) including a case (2), at least one electronic unit (72, 74) housed inside the case, and at least a first input and/or output terminal (A; B) accessible from the exterior of the case and including an electrically conductive element (100) which is mounted so as to be mobile with respect to the case. The input and/or output terminal is adapted to be electrically connected to an input and/or output terminal ($\mathbf{72}_A$, $\mathbf{74}_A$; $\mathbf{72}_B$, $\mathbf{74}_B$) of said electronic unit via a transmission line ($I/O_A$; $I/O_B$) and for allowing transmission of electric signals on the transmission line through the connecting element. The connecting element can occupy a first or second position in which the input and/or output terminal is respectively uncoupled from or coupled to the input and/or output terminal of the electronic unit. The portable electronic instrument further includes a transmission gate ($TG_A$; $TG_B$) inserted on the transmission line between the input and/or output terminal and the input and/or output terminal of the electronic unit, said transmission gate having a transmitting and non-transmitting state allowing the input and/or output terminal to be respectively coupled to or uncoupled from said input and/or output terminal of the electronic unit. A protective element ($TVS_A$, $TVS_B$) against electrostatic charges is also inserted on the transmission line between the input and/or output terminal and the transmission gate.

10 Claims, 7 Drawing Sheets

PORTABLE ELECTRONIC INSTRUMENT INCLUDING AT LEAST ONE INPUT/OUTPUT TERMINAL FOR ESTABLISHING A COMMUNICATION WITH AN ELECTRONIC UNIT ARRANGED WITHIN SAID INSTRUMENT

This application claims priority from European Patent Application No. 03021458.9 filed Sep. 23, 2003, the entire disclosure of which is incorporated herein by reference.

FIELD OF THE INVENTION

The present invention concerns generally a portable electronic instrument including a case, at least one electronic unit housed inside the case, and at least a first input and/or output terminal accessible from the outside of the case and including an electrically conductive connecting element, which is mounted so as to be mobile with respect to the case, this input and/or output terminal being adapted to be electrically connected to an input and/or output terminal of the electronic unit via a transmission line and to allow the transmission of electric signals across the transmission line through the connecting element, the connecting element being able to occupy a first or second position in which the input and/or output terminal is respectively uncoupled from or coupled to the input and/or output terminal of the electronic unit.

BACKGROUND OF THE INVENTION

Electronic instruments answering the general definition mentioned hereinbefore are already known, particularly from JP Patent Application No. 11-126115 A, JP Patent Application No 2001-175610 or EP Patent Application No. 1 134 630 A1 (corresponding to U.S. Pat. No. 6,625,087 —Paratte).

JP Patent Application No. 11-126115 A, and JP Patent Application No 2001-175610 disclose similar solutions consisting in providing the portable electronic instrument with a set of input/output terminals placed for example laterally on the instrument of the case. Each input/output terminal includes a connecting element mounted so as to be mobile with respect to the case. Each connecting element is adapted to occupy a first position (namely a non-pushed-in rest position) in which the connecting element is mechanically and electrically uncoupled from the corresponding transmission line inside the case and thus from the electronic unit. Each connecting element can occupy a second position (namely a pushed-in position) in which an electrical connection is established between the connecting element and the corresponding transmission line consequently allowing communication with the electronic unit. A specific adaptor is used to bring the various connecting elements into their second pushed-in position. In addition to the aforementioned input/output terminals, other similar terminals are for recharging the accumulator housed in the electronic unit with electric energy.

EP Patent Application No. 1 134 630 discloses another similar solution in which at least one push-button is used for transmitting and/or receiving data from the electronic instrument. In this case, the connecting element of the input/output terminal is formed by the stem of the push-button. The advantage of this latter prior art solution lies in the use of one or several control members (conventionally of the push-button type) for electrically connecting the electronic instrument to an external element, for example a personal computer. Consequently, no specific contact element is necessary for establishing an electrical connection between the electronic instrument and the external unit, this electrical connection being established as soon as the control member or members configured to have the aforementioned dual function are brought into the pushed-in position.

One advantage common to the aforementioned three solutions lies in the fact that, when it is not being activated, the connecting element ensures the mechanical and electrical uncoupling of the input/output terminals of and the corresponding transmission lines inside the case of the instrument. This ensures a first level of electrical protection for the interface between the electronic circuit housed inside the instrument case and the outside world.

This first level of protection is not, however, sufficient to ensure optimum protection for the interface. Thus, for example, although the connecting elements ensure the mechanical and electrical uncoupling of the input/output terminals and the transmission lines, there nonetheless remains a relatively significant risk of the electric charges being able to be introduced on the transmission lines during activation of the connecting elements. This risk is even greater if the electrical potential of the connecting elements is left floating in the rest state (in the non-pushed-in position).

Moreover, directly interfacing an electronic unit on the transmission lines cannot be envisaged. Indeed, the electronic unit is typically interfaced with other units, generally by means of a bus, which is shared by such components. If the electronic unit were directly interfaced on the transmission lines of the various input/output terminals, there would then be a significant risk of the inadvertent or non-inadvertent activation of the connecting elements causing interference on the bus (for example during a data read or write operation executed in a memory by a processing unit). If a control member is used to fulfil the function of the input/output terminal (like the solution disclosed in EP Patent Application No. 1 134 630 A1), this problem then becomes critical since the control member can be activated by the user at any time, in particular while the instrument is being handled in an electrically conductive medium (for example in water).

In order to respond to the problem of electrostatic discharge, using protective electrical components to establish a path for the discharge of the accumulated electrical charges is known. These are well known protective components, called ESD ("electro-static discharge") or TVS ("transient voltage suppressor") components. These components have, however, a major drawback insofar as they have a very high stray capacitance (of the order of 1 nF). If these components are placed on the lines in direct connection with the electronic unit, this stray capacitance will thus be present on the lines and will not only generate high power consumption but will also affect the response time of said lines.

SUMMARY OF THE INVENTION

It is therefore a general object of the present invention to propose a solution that ensures optimum electrical protection of the interface between the electronic unit and the outside world. It is another object of the present invention to propose a solution that makes interfacing possible without any interference between the outside world and an electronic unit coupled to other components, for example via a bus.

The present invention thus concerns a portable electronic instrument whose features are set out in the appended claims.

Advantageous embodiments of the present invention form the subject of the dependent claims.

The proposed solution consists in particular of providing a transmission gate inserted on the transmission line between the input/output terminal and the input/output terminal of the electronic unit, this transmission gate having a transmitting or non-transmitting state allowing the input/output terminal to be respectively coupled or uncoupled from the input/output terminal of the electronic unit. This transmission gate is completed by a protective element against electrostatic discharge inserted on the transmission line between the input/output terminal and the transmission gate.

The portion of the transmission line located between the input/output terminal and the transmission gate typically constitutes a part with high power consumption. Because of its arrangement, the transmission gate thus enables this high power consuming part to be uncoupled from the input/output terminals of the electronic unit whereas the input/output terminals are not used for communicating with the electronic unit. Consequently, the ESD protective element does not interfere, in this state, in the exchanges or communications between the electronic unit and the other components of the system. The ESD protective element still fulfils however its first function, which consists in allowing a discharge path to be established between the transmission line (on the portion located between the input/output terminal and the transmission gate) and the circuit's earth, as soon as electric charges are accumulated or are introduced onto the line in too great a number. The ESD protective element thus assures protection for the transmission gate input and the downstream components, including the electronic unit.

The ESD protective unit and the transmission gate cooperate together to assure optimum electric protection for the interface between the electronic unit and the outside world. This protection is added to that provided by the mechanical and electrical uncoupling function assured by the input/output terminal and its mobile connecting element.

According to a preferred embodiment, the electronic unit is coupled to a bus, the transmission line and the input/output terminal of the electronic unit being coupled to a bus line. Preferably, this bus line is brought, in the unoccupied state, to a reference voltage, first means for pulling the bus line up to the reference voltage being connected to the bus line, between the transmission gate and input/output terminal of the electronic unit. Second means for pulling the bus line up to the reference voltage are also connected to the transmission line, between the input/output terminal and the transmission gate. Consequently, when the transmission gate is made to transmit to allow a connection to be established between the input/output terminal placed on the instrument case and the input/output terminal of the electronic unit, the second means complete or supplements the first means in order to compensate for the effects of the stray capacitance of the ESD protective element.

According to another preferred embodiment, the portable electronic instrument includes a user interface, this user interface including at least a first control member mounted so as to be mobile on the case and able to be activated by a user, this first control member also playing the part of the input/output terminal. According to this embodiment, the control member is advantageously made in the form of a push-button mounted so as to be mobile in an assembly orifice arranged in the case so as to have a translation travel along an activation axis, this push-button being able to be activated by pressure to be brought from a first position called the non-pushed in position to a second position called the pushed-in position. This push-button includes an electrically conductive stem, forming the connecting element of the input/output terminal, which passes through the assembly orifice and which includes first and second ends opening out respectively inside and outside the case.

Preferably, the control member activates a first electric contact, electrically insulated from the connecting element, to generate in response a control signal, and a second electric contact for establishing, in the pushed-in position, an electrical contact between the connecting element of the input/output terminal and the transmission line. When the control member occupies the first position, this second electrical contact establishes an electrical connection between the connecting element and a determined electrical potential thus preventing the accumulation of electrical charges on the connecting element.

Generally, it is in fact advantageous to provide means for bringing the connecting element to a determined electrical potential when the connecting element occupies the first uncoupling position, and for interrupting the connection of the connecting element to the determined electrical potential when the connecting element occupies the second coupling position and thus allowing transmission of electric signals on the transmission line. Consequently, electrical charges cannot accumulate on the connecting element in the first place.

BRIEF DESCRIPTION OF THE DRAWINGS

Other features and advantages of the present invention will appear more clearly upon reading the following detailed description of various embodiments of the invention given solely by way of non-limiting examples and illustrated by the annexed drawings, in which.

DESCRIPTION OF PREFERRED EMBODIMENTS

Figure 1:
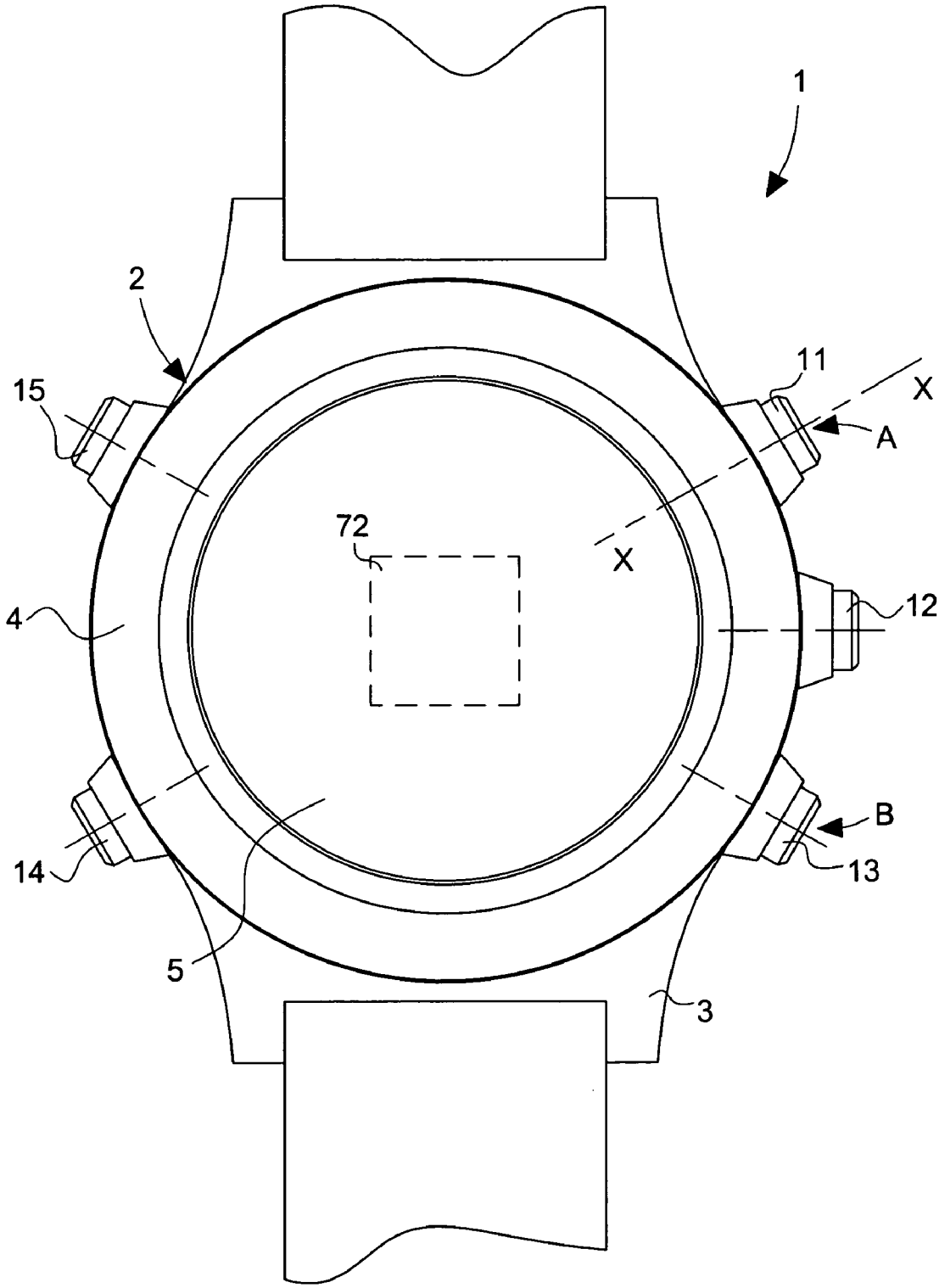
FIG. 1 shows a general plan view of an electronic instrument according to the invention shown advantageously here in the form of a wristwatch including a plurality of control members of the push-button type.

The invention proceeds from the general idea that consists in connecting a portable electronic instrument (for example a wristwatch) to an external electrical or electronic device via at least one input/output terminal accessible from the exterior of the case of the portable electronic instrument (advantageously at least one control member of the user interface with which the portable electronic instrument is fitted). "Transmission of electric signals" will cover in particular the communication of data to and/or from the portable electronic instrument. The external device can thus be an electronic communication device, for example a personal computer. "Electronic unit" also means any unit with which one wishes to interact through input/output terminals, in particular a processing unit or a memory unit.

The preferred embodiment that will be described in the following description is advantageously based on the use of two control members that are already present (in this case two push-buttons) to establish communication with an electronic unit housed inside the instrument case. It will be understood that the two control members thus configured fulfil two functions, namely their first control function for selecting functions of the portable electronic instrument (selection of operating or data modes, data updating or settings for the portable electronic instrument, for example the time and/or the date, etc.) and the additional function of input/output terminal for establishing communication with at least one electronic unit housed inside the case of the instrument.

It should however be mentioned that the invention is not limited to the use of control members as input/output terminals. In order to implement the invention, each input/output terminal need only be fitted with an electrically conductive connecting element, which is mounted so as to be mobile with respect to the case in order to be able to occupy at least two distinct positions in which this connecting element is coupled to or uncoupled from the corresponding transmission line (like for example the solutions disclosed in the aforementioned JP Patent Application No. 11-126115 A, and JP Patent Application 2001-175610). The additional use of the input/output terminal as control member, as described hereinafter, is however particularly advantageous insofar as specific terminals are not necessary.

It will also be understood that the transmission of electric signals can be established as soon as the control members configured for this purpose are brought into their coupling position (in the pushed-in position). The connection of the portable electronic instrument to the external device will thus be established owing to an adaptor arranged for bringing the control members concerned into the pushed-in position. This adaptor will not be described here since it does not directly concern the subject of the present invention. In the following description, it need only be understood that this adaptor is arranged to act as communication interface with an external processing unit, such as a personal computer.

The present invention will be described with reference to a timepiece advantageously taking the form of a wristwatch. The invention nonetheless applies in an identical manner to any portable electronic instrument whether or not it fulfils a horological function.

FIG. 1 shows a plane view of the whole of a wristwatch, designated as a whole by the reference numeral 1, forming an example implementation of the invention. It includes in particular a case 2 delimited in this example by a bottom part 3 forming the middle part and back cover, and a top part 4 forming the bezel, which also carries a glass 5. Bezel 4 is fitted in a conventional manner onto middle part 3, a sealing gasket being inserted between these elements to assure sealing of case 2.

In this example, five control members of the push-button type pass through middle part 3, respectively designated by the reference numerals 11, 12, 13, 14 and 15. It goes without saying that this example is given solely by way of illustration. The five control members 11 to 15 together form a user interface with which the user can interact to select the various functions of wristwatch 1.

Control members 11 to 15 are placed laterally here on middle part 3 at typical locations for a wristwatch, namely substantially at 2 o'clock, 3 o'clock, 4 o'clock, 8 o'clock and 10 o'clock respectively. It goes without saying that control members 11 to 15 could be arranged at other locations. One of the control members at least could thus be placed on the front face of the watch, for example at 6 o'clock.

In the following description, we will be concerned only with the structure of control member 11. In this example, control members 12, 13, 14 and 15 have a similar configuration. More particularly, the two control members 11 and 13 form input/output terminals (designated A and B respectively) for establishing communication with at least one electronic unit housed inside case 2 (such an electronic unit is shown schematically in FIG. 1 and bears the reference numeral 72). Control members 14 and 15 are used for recharging an accumulator of the portable electronic unit with electric energy. Control unit 12 is only used as reserve and could be configured like a conventional control member for fulfilling only its control role. This control member 12 could also be configured like a conventional stem-crown for setting the time of the watch.

Figure 2A:
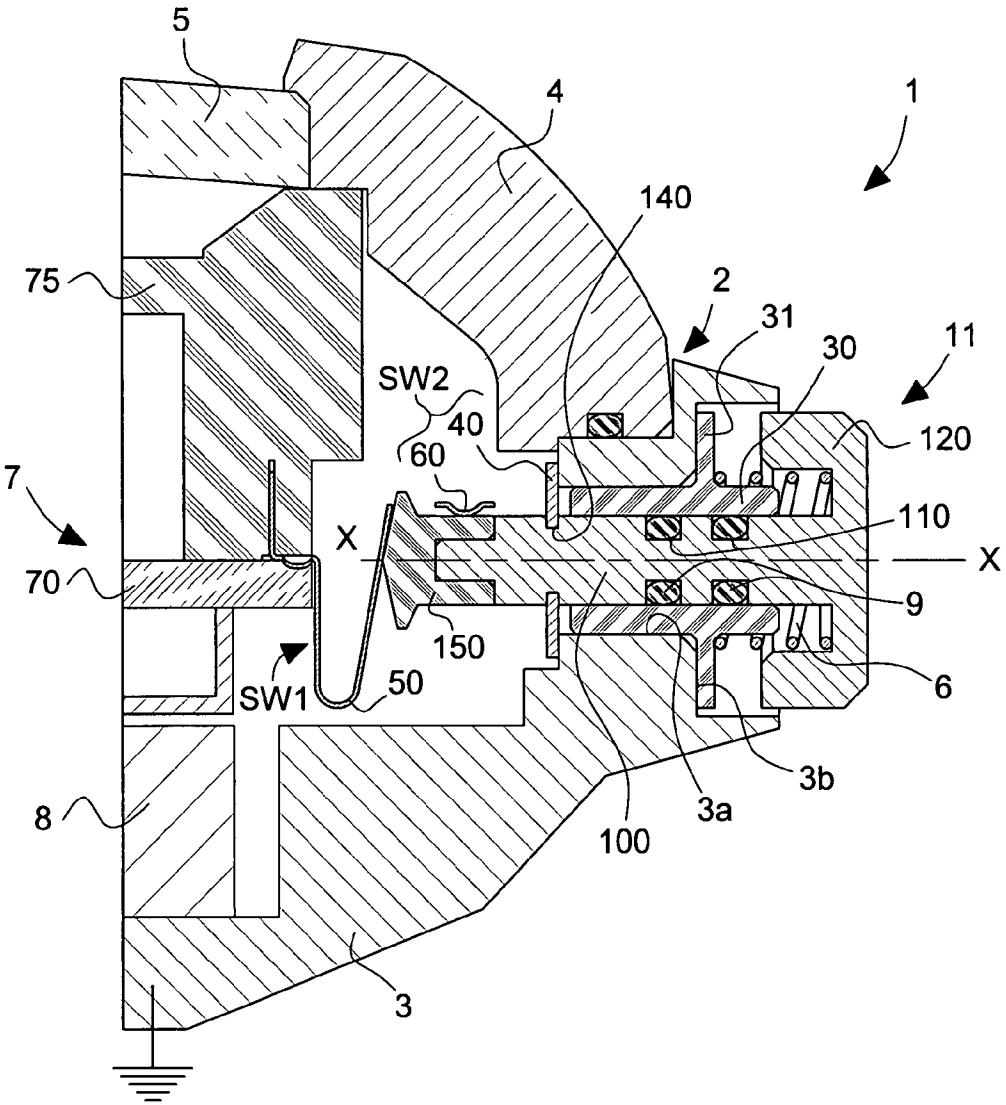
FIG. 2*a* is a cross-sectional view of one of the control members of the instrument of FIG. 1, this control member being illustrated in its non-pushed-in position.

FIG. 2*a* shows a partial cross-sectional view of FIG. 1 taken at control member 11 along its activation axis designated X—X. As already mentioned, control members 12, 13, 14 and 15 have a similar configuration. Control member 11 is mounted so as to be mobile in an assembly orifice 3*a* arranged in middle part 3 so as to have a translation travel along activation axis X—X. Control member 11 can be activated by pressure, like a conventional push-button, to be brought from a first position called the non-pushed-in position, as illustrated in FIG. 2*a*, into a second position, called the pushed-in position illustrated in FIG. 2*b*.

Control member 11 is made up mainly of a stem 100, of elongated shape, made of an electrically conductive material, advantageously of metal. This stem 100 preferably, but not exclusively, has a cylindrical shape and passes through middle part 3 from one side to another. This stem 100 forms the connecting element of each input/output terminal. A first end of stem 100 thus extends inside the cavity formed by middle part 3 whereas the second end of stem 100 extends outside middle part 3 so as to be able to be actuated by a user. Sealing is thus assured in a conventional manner by one or several O-ring joints 9 housed in one or several grooves 110 arranged on stem 100.

On its second end, stem 100 ends in a head 120 of larger diameter. In this example, stem 100 and head 120 of the control member are made in one piece. By way of alternative, it is perfectly possible to envisage making these two elements separately and then securing them to each other or even overmoulding a head of plastic material on conductive stem 100. In order to fulfil the desired electric signal transmission function, it will be understood that in every case electric access should be assured to stem 100 from the exterior. Overmoulding or mounting a plastic head on the stem should thus be such that the external end of the stem can be electrically contacted from the exterior.

Middle part 3 is preferably also made of an electrically conductive material, stem 100 being consequently insulated from middle part 3 by an insulating sleeve 30. In this preferred example, middle part 3 is also brought, during operation, to a determined electrical potential, here the earth potential of the portable instrument as schematised in the Figures. The usefulness of this electrical connection will appear more clearly in the following description.

Insulating sleeve 30 has a generally tubular shape with a shoulder 31 arranged to abut, from outside middle part 3, on a corresponding shoulder 3*b* arranged in assembly orifice 3*a*. This insulating sleeve 30 is thus introduced into assembly orifice 3*a* from the exterior and is preferably secured to middle part 3, for example by being driven in, screwed in or bonded. This sleeve 30 can advantageously be made of a plastic material, ceramic material, eloxated aluminium, or any other material insofar as at least the contact surface between sleeve 30 and the neighbouring conductive parts is electrically insulated.

To a certain extent, it could be possible to envisage using a sleeve made of a material with high electric resistivity (i.e. slightly conductive) such that a sufficient current can flow between stem 100 and conductive middle part 3, thus preventing the accumulation of electric charges on stem 100, the resistivity of the sleeve being however chosen to be sufficiently high (for example several kΩ or MΩ) so as not to disturb the operation of the internal bus.

Figure 2B:
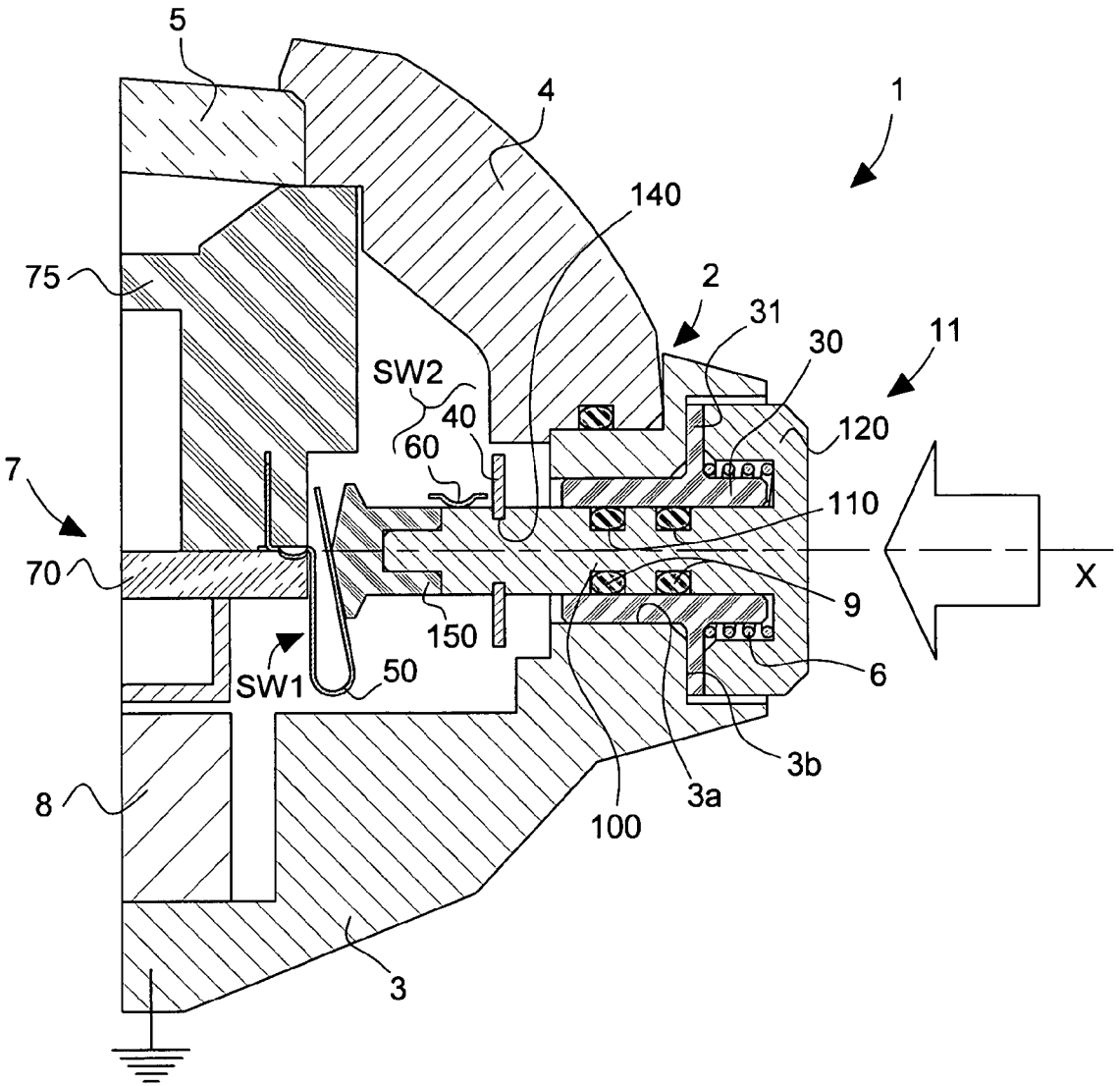
FIG. 2*b* is a similar cross-sectional view to that of FIG. 2*a* in which the control member is illustrated in the pushed-in position.

Elastic return means 6, formed in this example of a helical spring, is placed between shoulder 31 of insulating sleeve 30 and head 120 of the control member. When pressured is applied onto the control member, return means 6 is thus compressed between shoulder 31 and head 120 as illustrated in FIG. 2*b*, thus exerting a return force tending to bring the control member back from its pushed-in position to its non-pushed-in position. It will be noted that shoulder 31 of the insulating sleeve also assures that head 120 of the control member, which is conductive here, does not go back into contact with middle part 3.

The control member also includes a retaining element 40 adapted to retain stem 100 of the control member axially. For this purpose, retaining element 40 is secured to stem 100 and is placed on the inner side of middle part 3 in order to frustrate the action of return means 6 which tends to extract the control member from its housing. Retaining element 40 is advantageously configured like a traditional retaining key, which is introduced into a groove 140 arranged on stem 100. This retaining element 40 is also made of an electrically conductive material.

In FIG. 2*a*, it can be seen that in the non-pushed-in position, retaining element 40 abuts onto middle part 3, at the periphery of assembly orifice 3*a*. Consequently, an electrical connection is assured, in the non-pushed-in position, between stem 100 of the control member and middle part 3. Stem 100 of the control member is thus brought to the same electrical potential as middle part 3. In the pushed-in position, however, this electrical connection is interrupted because of the axial movement of retaining element 40, which accompanies the movement of stem 100.

Generally, it will thus have been understood that the structure of the control member is such that, in the non-pushed-in position, stem 100 of the control member is brought to a determined electrical potential, thus making the accumulation of electric charges on said stem impossible. In the pushed-in position, however, this electrical connection is interrupted, thus making the transmission of electric signals possible, via stem 100. In order to implement the invention, it has to be understood that this electrical connection to earth, in the non-pushed-in position, is not strictly necessary.

We will now examine more particularly the configuration of the control device and the structure of the electric contacts, which assure, on the one hand, the first control member function and, on the other hand, the additional function of electric signal transmission means.

Figure 3:
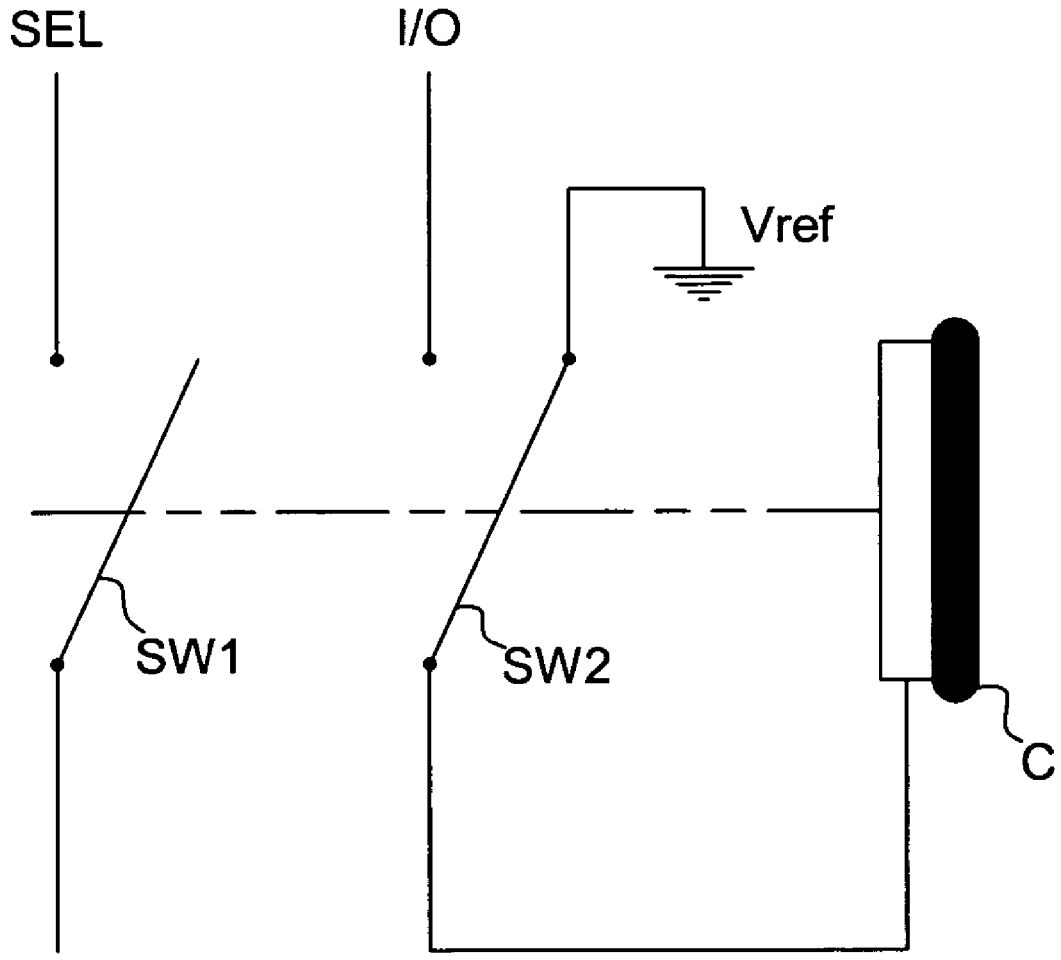
FIG. 3 is a schematic view of the configuration and operation of the control member of FIGS. 2*a* to 2*d* in which, in addition to its conventional control function, this control member fulfils an additional function allowing transmission of electrical signals from and/or to the electronic instrument.

FIG. 3 shows a view of the principle of the configuration and operation of the control device envisaged for allowing the control member to fulfil, in addition to its conventional control function, an additional function for transmitting electric signals from and/or to the electronic instrument. The control member is shown schematically in this Figure and bears the reference C. This control member C cooperates with a first electric contact SW1 in a conventional manner in order to fulfil its control function. A control signal SEL is thus produced in response to activation of electric contact SW1, namely in response to pressure on control member C. A second electric contact SW2, distinct from the first contact SW1 assures the connection with an input/output line I/O connected for example to a processing unit housed inside the portable electronic instrument. This second electric contact SW2 fulfils an additional function for establishing an electric connection between the input/output I/O and control member C, or more exactly the stem of this control member C. This possibility is schematised in FIG. 3 by the connection of control member C and input/out I/O through electric contact SW2. This connection is only established when control member C is brought in the pushed-in position to close electric contact SW2. In the non-pushed-in position, electric contact SW2 connects, as schematised, control member C to a determined electric potential $V_{REF}$ shown here as an electric potential forming earth. It will have been understood that the first and second electric contacts SW1 and SW2 are independent but are nonetheless actuated simultaneously in response to pressure on control member C.

The peculiarity of the proposed control member lies essentially in the fact that, in the non-pushed-in position, the electrically conductive part of control member C, which acts as electric connecting means with the input/output I/O (namely the stem of the control member), is not left in the floating state but is brought to a determined electric potential, thus preventing any accumulation of electric charges on this part of the control member.

With reference again to FIGS. 2*a* and 2*b*, the configuration of the aforementioned electric contacts will now be described. In these Figures, it can be seen that middle part 3 defines an inner cavity occupied, in a conventional manner, by an electronic module 7 (shown partially in FIG. 2*a*) including in particular a printed circuit board, or PCB, 70 carrying various electric and electronic components (not shown in these Figures) including a data processing unit (for example a microcontroller or a microprocessor), storage means (for example EEPROM, FLASH or similar) and other components for implementing the functions of wristwatch 1. Horological components (time base, frequency divider analogue and/or digital display means, etc.) are in particular conventionally provided in this example to fulfil various horological functions, including in particular the time display. Reference 75 indicates an optional element forming a spacer arranged on the top face of PCB 70 and which carries in particular the display means of the electronic instrument.

In FIGS. 2*a* and 2*b*, an electric energy source 8 has also been partially shown, for powering the aforementioned electronic module 7. This may be a conventional battery or a rechargeable accumulator (which can for example be recharged via control members 14, 15 as already mentioned).

Figure 2C:
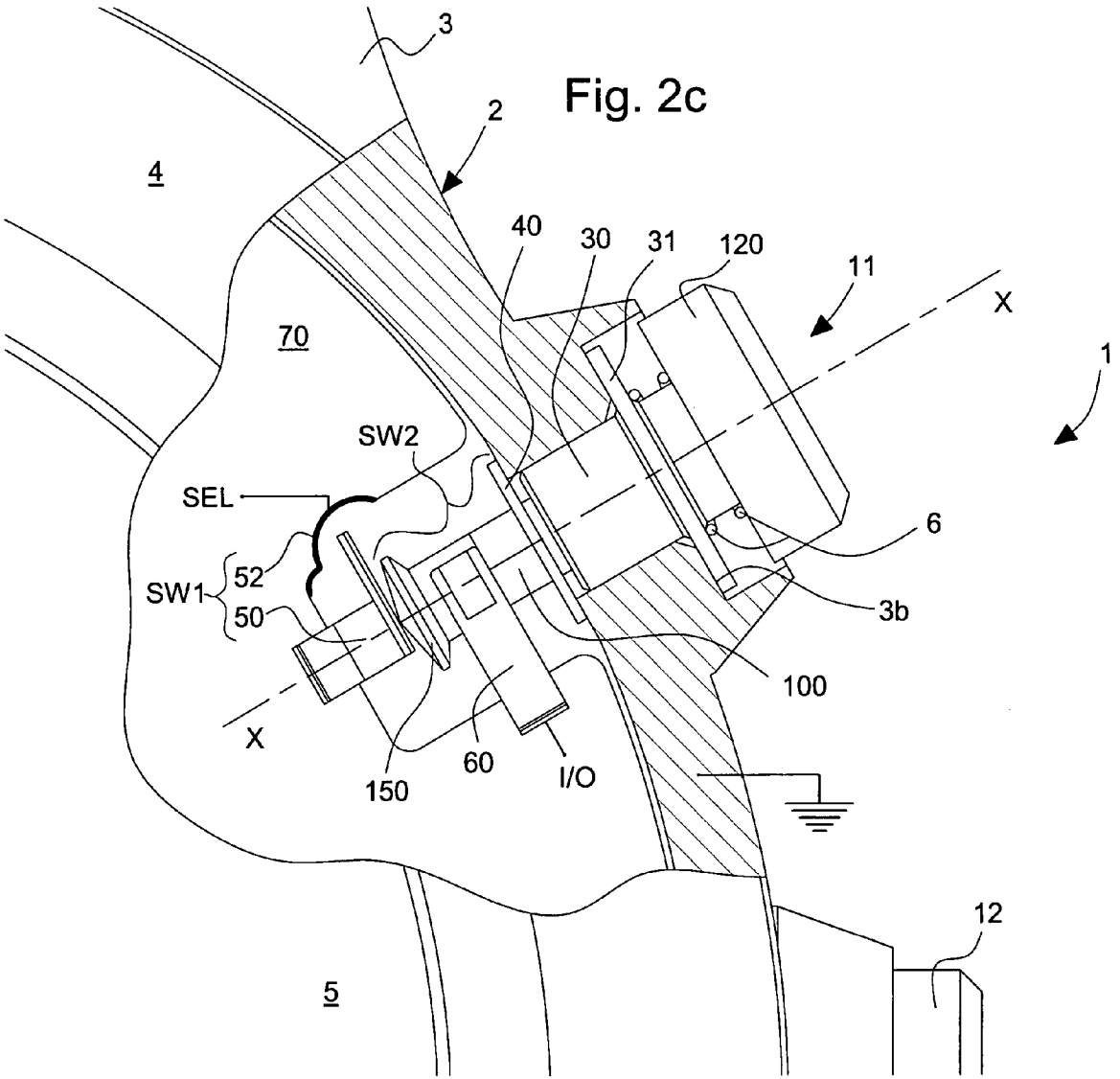
FIG. 2*c* is a partial plan view of the control member of FIG. 2*a* in its non-pushed-in position.
Figure 2D:
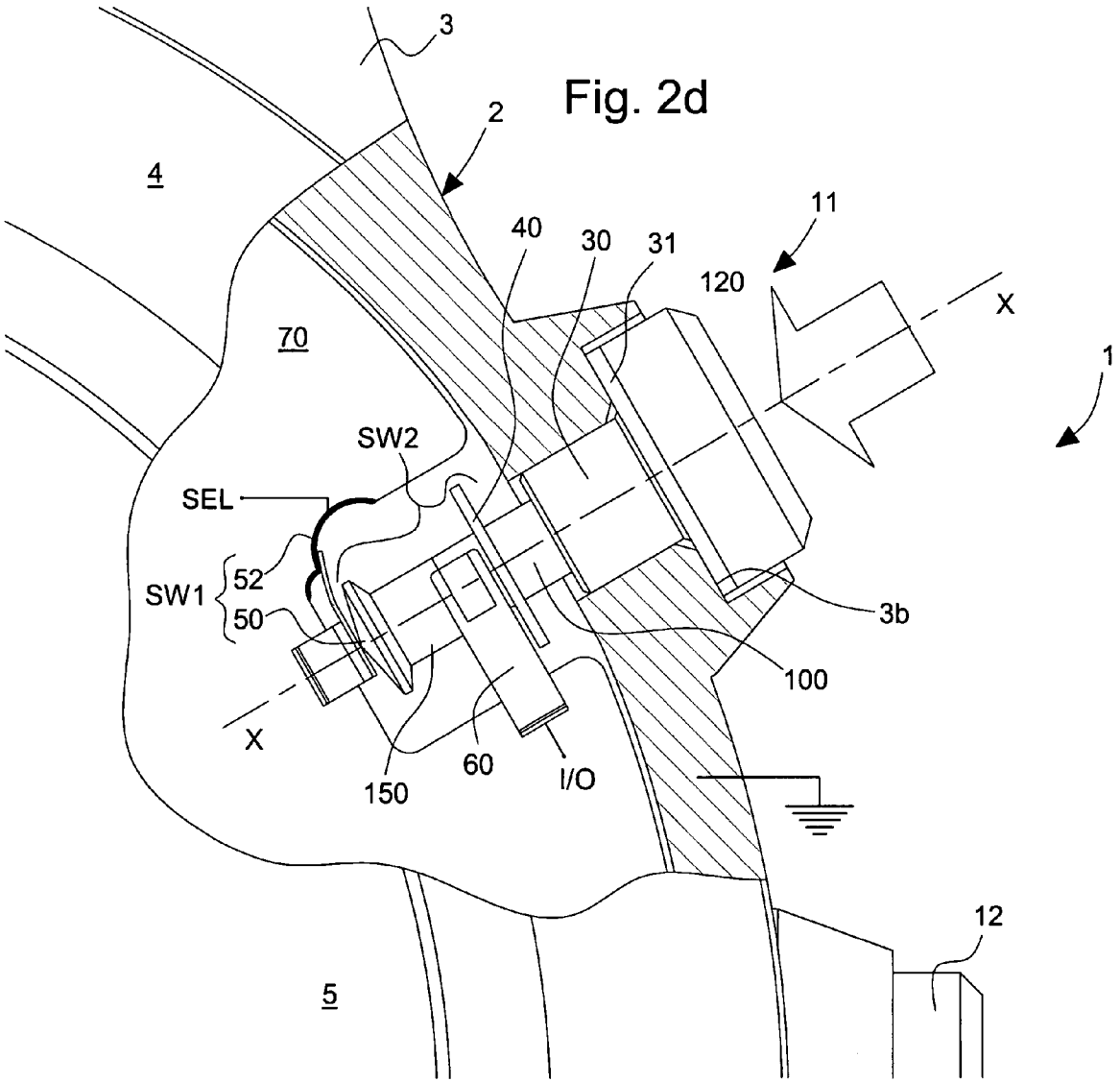
FIG. 2*d* is a similar plan view to that of FIG. 2*c* in which the control member is illustrated in the pushed-in position.

In this embodiment, the first electric contact SW1 of FIG. 3 is made in a conventional manner in the form of an electric contact strip 50 including a base secured to electronic module 7 (this base is held here between PCB 70 and spacer 75) and a flexible extension, which cooperates with the end of stem 100, this end being electrically insulated from contact strip 50 by an insulating sheath 150 able to be made in a similar material to that of insulating sleeve 30. The flexible extension of contact strip 50 is arranged to be brought conventionally into contact with the other part of the first electric contact (not shown in FIGS. 2*a* and 2*b*). In this particular case, it is a metallisation 52 formed on the edge of PCB 70 as illustrated in the partial plan view of FIG. 2*c*. In this FIG. 2*c*, spacer 75 has not been shown in order to allow the whole of the display device to be seen. FIG. 2*d* shows a similar plan view to that of FIG. 2*c*, control member 11 in the pushed-in position, where one can see the flexible extension of contact strip coming into contact with metallisation 52.

The function of the second electric contact SW2 of FIG. 3 is achieved owing to retaining element 40 secured to stem 100 and to a second electric contact strip 60 arranged tangentially to stem 100 in proximity to its end covered by insulating sheath 150. This electric contact strip 60 is also held by its base between PCB 70 and spacer 75. Consequently, in the non-pushed-in position (FIGS. 2*a* and 2*c*), electric contact strip 60 is in contact with insulating sheath 150 and in the pushed-in position (FIGS. 2*b* and 2*d*), electric strip 60 is in contact with stem 100.

In FIGS. 2*a* to 2*d*, it can be seen that insulating sheath 150 fulfils two functions, namely the electric insulation between stem 100 and the first electric contact (whatever the position of the control member) and the electric insulation between stem 100 and electric contact strip 60 (only in the non-pushed-in position). Electric contact strip 60 could of course be insulated from stem 100 by means of an insulating sheath distinct from insulating sheath 150.

It will also be noted that insulating sheath 150 ends here in a portion of larger diameter. This feature is not necessary but prevents any electric contact between strips 50 and 60, the portion of larger diameter being inserted between these two strips.

Figure 4:
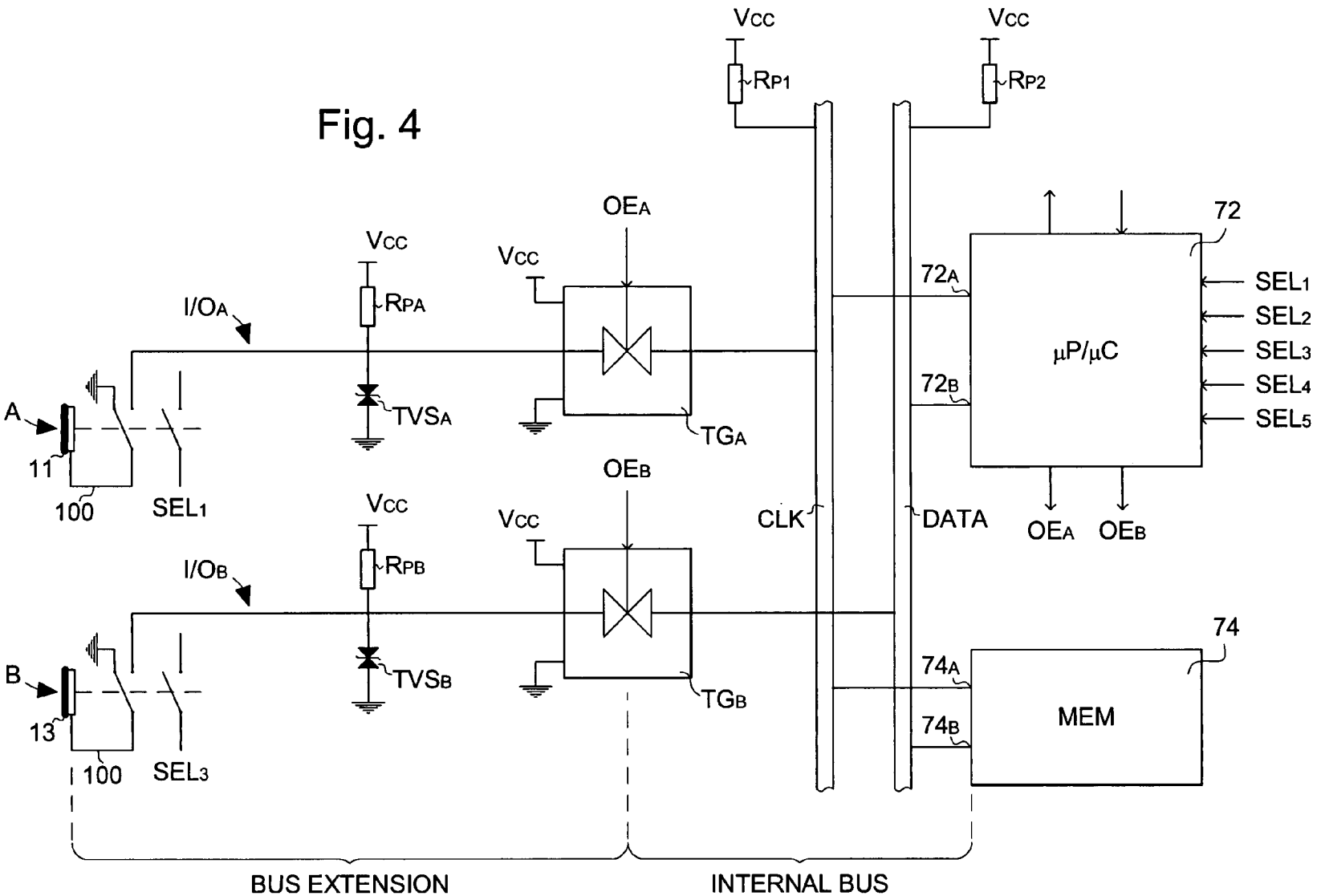
FIG. 4 is a block diagram illustrating a preferred embodiment of the interface between the control members and the electronic circuit of the instrument.

Reference will now be made to the illustration of FIG. 4 to describe a preferred embodiment of the interface between the input/output terminals accessible from outside the case of the instrument and the electronic circuit of the instrument. As already mentioned hereinbefore, two control members (namely control members 11 and 13) advantageously form first and second input/output terminals A and B. Each of these input/output terminals A, B is capable of being coupled to a corresponding input/output terminal of at least one electronic unit (including particularly units 72, 74) via a transmission line $I/O_A$, respectively $I/O_B$. In FIG. 4, two distinct electronic units have been shown by way of example, namely a processor unit 72 (it may be a microcontroller or a microprocessor) and a memory 74 (for example a non volatile memory of the EEPROM or FLASH type), these components being for example carried by the aforementioned PCB 70. Each of these electronic units includes first and second input/output terminals respectively designated by the reference numerals $\mathbf{72}_A$, $\mathbf{74}_A$ and $\mathbf{72}_A$, $\mathbf{74}_A$. In this preferred example, each of electronic units 72, 74 is advantageously coupled via its input/output terminals $\mathbf{72}_A$, $\mathbf{74}_A$ and $\mathbf{72}_A$, $\mathbf{74}_A$ to an internal bus including two lines designated CLK and DATA. The first and second transmission lines $I/O_A$ and $I/O_B$ are respectively connected across these two bus lines.

Bus lines CLK and DATA are respectively used for transmission of a clock (or clocking) signal and for serial data transmission. Several communication protocols exist using buses with two lines as in the present case. These communication protocols will not be described here. One need only know that processor unit 72 can for example act as a master and control the operations and data flow across the bus and that processor unit 72 can address selectively any other unit coupled to the bus (including memory 74), for example by sending an addressing frame on data line DATA.

It should be noted that interfacing via a bus is not strictly necessary. It would for example be perfectly possible to envisage coupling transmission lines $I/O_A$ and $I/O_B$ on the input/output terminals of processor unit 72 solely and interfacing processor unit 72 and memory 74 by means of a separate bus. The proposed structure is, however, advantageous in that one can access one or other of units 72, 74 (or other units coupled to the bus) via input/output terminals A, B.

Referring more particularly to each of transmission lines $I/O_A$ and $I/O_B$ it can be seen that a transmission gate $TG_A$, respectively $TG_B$, is inserted on the transmission line between the input/output terminal A, respectively B, and the corresponding input/output terminal $\mathbf{72}_A$, $\mathbf{74}_A$ and $\mathbf{72}_A$, $\mathbf{74}_A$ of each electronic unit 72, 74. Each transmission gate $TG_A$, $TG_B$ has a transmitting or non-transmitting state allowing the corresponding input/output terminal A, B to be respectively coupled to or uncoupled from the corresponding input/output terminal of each electronic unit 72, 74. The transmission gates are well known components. Reference can be made for example to the specification of the component NC7SZ66 marketed by the Fairchild Semiconductor Company for a detailed description of such a component.

In addition to the aforementioned transmission gates $TG_A$, $TG_B$, a protective element against electrostatic discharges $TVS_A$, $TVS_B$, is also inserted on each of transmission lines $I/O_A$ and $I/O_B$ between the input/output terminal A, B and the transmission gate $TG_A$, $TG_B$. In FIG. 4, these protective elements $TVS_A$, $TVS_B$ are shown as a double diode head-to-tail. It is essentially a passive component, also well known, allowing a discharge path to be established as soon as a voltage across the terminals of this component exceeds a determined threshold (for example ten or so volts). In the present case, each protective element $TVS_A$, $TVS_B$, is connected between the transmission line $I/O_A$ or respectively $I/O_B$ and an earth potential. As mentioned in the preamble, this type of protective element typically has a stray capacitance of a high value (of the order of 1 nF).

The portion of transmission line $I/O_A$, $I/O_B$ located between input/output terminal A, B and transmission gate $TG_A$, $TG_B$ typically constitutes a high power consumption part. Because of its arrangement, transmission gate $TG_A$, $TG_B$ thus enables this high power consumption part to be uncoupled from the input/output terminals of each electronic unit 72, 74 while input/output terminals A, B are not being exploited for communicating with the electronic circuit of the instrument. Consequently, in this state, protective element $TVS_A$, $TVS_B$ does not disturb the exchanges or communications between the electronic units coupled to the internal bus. Protective element $TVS_A$, $TVS_B$, however, still fulfils its first function, which consists of allowing a discharge path to be established between transmission line $I/O_A$, $I/O_B$ (on the portion located between input/output terminal A, B and transmission gate $TG_A$, $TG_B$) and the circuit's earth, as soon as electric charges accumulate or are introduced in too high a number on this line. Protective element $TVS_A$, $TVS_B$ thus assures protection of the associated transmission gate $TG_A$, $TG_B$ and components located downstream, including processor unit 72 and memory 74.

It will thus have been understood that protective element $TVS_A$, respectively $TVS_B$ and transmission gate $TG_A$, respectively $TG_B$ cooperate jointly to assure optimum electrical protection of the interface between the electronic circuit of the instrument and the outside world. This protection is added to that assured by the mechanical and electrical uncoupling function provided by input/output terminal A, B and its mobile connecting element, namely control member 11, respectively 13, in this example.

As illustrated in FIG. 4, the transmitting or non-transmitting state of each transmission gate $TG_A$, $TG_B$ is selected by means of a control signal $OE_A$, respectively $OE_B$ applied on an input of the gate. This control signal $OE_A$, $OE_B$ is advantageously produced by processor unit 72 itself. The transmitting state of each gate can be actuated by processor unit 72 as soon as suitable conditions for effecting interfacing with the outside world are present. The transmitting state of transmission gates $TG_A$, $TG_B$ will, in particular, only be actuated when the input/output terminals have to be exploited for communicating with the electronic circuit of the instrument. This is the case when the electronic instrument is placed on its adaptor and the connecting elements of the input/output terminals are brought into their coupling position. In the example illustrated, this must not, however, be the case during conventional actuation of the control members, for example when functions of the portable electronic instrument are selected.

Actuation of the transmission gates $TG_A$, $TG_B$ can be carried out in various manners. In FIG. 4, it can be seen that the processor unit 72 receives five actuation signals $SEL_1$ to $SEL_5$ respectively originating from control members 11 to 15 forming the user interface of the instrument. In FIG. 4, the electric contacts of control members 11 and 13 for generating actuation signals $SEL_1$ to $SEL_3$ are also schematically shown. Actuation of transmission gates $TG_A$, $TG_B$ could thus be carried out following simultaneous and/or prolonged actuation of the five control members 11 to 15 (a situation which would occur essentially when the instrument is placed on its adaptor). Alternatively, a communication mode actuation function could be predefined in the range of functions of the electronic instrument and this function could be called up and selected by means of the instrument's user interface.

As soon as transmission gates $TG_A$, $TG_B$ are actuated, it will be understood that the high power consumption part of transmission lines $I/O_A$, $I/O_B$ (one could also speak of an extension of the bus) will be connected to the internal bus of the electronic instrument. This situation will only occur when the instrument is in communication mode. At that moment, the instrument is placed on its adaptor, thus the power consumption problem is considerably less critical. Indeed, the electronic instrument can be powered via an external supply or recharging device arranged in the adaptor and connected to the instrument via other terminals, for example via control members 14 and 15.

The stray capacitance of each protective element $TVS_A$, $TVS_B$ can however still constitute a problem. Indeed, this stray capacitance not only has an influence on the power consumption, but also on the response time of the lines where data is carried. In the present case, each line CLK, DATA of the internal bus is brought, in the unoccupied state, to a reference voltage, here a high voltage $V_{CC1}$ via a "pull-up" device. Here this is a resistive element $R_{P1}$, respectively $R_{P2}$ (or pull-up resistor) connected between the bus line CLK, respectively DATA, and high voltage $V_{CC}$. The value of this resistance is selected as a function of criteria of power consumption, bus response time and the capacitance of the interfaced components for "controlling" the bus, this value having to be high in order to reduce power consumption on the bus, while being sufficiently low, compared to the capacitance present on the bus, to minimise the response time.

During actuation of transmission gates $TG_A$, $TG_B$, the stray capacitance of each protective element $TVS_A$, $TVS_B$ is found again on the bus line. This stray capacitance is consequently added to the capacitance already present on the internal bus and would result, at equal resistance, in an increase in the bus response time. This is why an additional pull-up device is placed on each of transmission lines $I/O_A$, $I/O_B$ between the input/output terminals A, B and transmission gates $TG_A$, $TG_B$. Like elements $R_{P1}$, $R_{P2}$, these are again, in this example, resistive elements $R_{PA}$, $R_{PB}$ connected, this time, between the high power consumption portions of transmission lines $I/O_A$, $I/O_B$ and high voltage $V_{CC}$. These additional resistive elements thus compensate for the increase in capacitance present on the bus lines during actuation of transmission gates $TG_A$, $TG_B$. It will be understood that resistive elements $R_{P1}$, $R_{P2}$, could be replaced by other operationally similar devices such as current sources for example.

It will be understood that various modifications and/or improvements evident to those skilled in the art can be made to the embodiments described in the present description without departing from the scope of the invention defined by the annexed claims. In particular, the present invention is not limited solely to use in a wristwatch but also applies to any other application in a portable electronic instrument.

Moreover, the use of control members as input/output terminals, although preferable and advantageous, is not necessary. Any other uncoupling device including an electrically conductive connecting element mounted so as to be mobile with respect to the case of the portable electronic instrument and allowing electric access to the electronic circuit housed inside said case can be used (like for example the prior art solutions disclosed in JP Patent Application No. 11-126115 A and JP Patent Application No. 2001-175610.

The control member structure described can also undergo numerous modifications without however affecting the functions desired for implementing the claimed invention. Middle part 3 of the instrument could thus alternatively be made of a non-conductive material in which case sleeve 30 is no longer necessary. In such case, it will be preferable to arrange, in proximity to stem 100, a conductive reference element brought to the determined electric potential and for stem 100 to be brought into contact with this reference element in a non-pushed in position.

Instead of push buttons, one could also use any other type of control member insofar as it has two distinct positions, respectively for coupling and uncoupling the input/output terminals. One may for example think of a stem-crown having at least two distinct axial positions. The movement of the connecting element could also follow a movement other than in translation. One may for example think of a control member where the mobile element undergoes a movement in rotation.

It will have been understood finally that the nature of the electronic unit with which one wishes to establish a connection through input/output terminals can vary. It may be a processor unit as described, simply a memory unit or a unit whose operating features one wishes to adjust (for example a frequency divider circuit, a sensor, etc.)

What is claimed is:

1. A portable electronic instrument including a case, at least one electronic unit housed inside said case, and at least a first input and/or output terminal accessible from the exterior of said case and including an electrically conductive element which is mounted so as to be mobile with respect to said case, said at least first input and/or output terminal being adapted to be electrically connected to an input and/or output terminal of said electronic unit via a transmission line and for allowing transmission of electric signals on said transmission line through said connecting element, said connecting element being able to occupy a first or second position in which said at least first input and/or output terminal is respectively uncoupled from or coupled to said input and/or output terminal of the electronic unit;

wherein said portable electronic instrument also includes:

a transmission gate inserted on said transmission line between said at least first input and/or output terminal and said input and/or output terminal of the electronic unit, said transmission gate having a transmitting and non-transmitting state allowing said at least first input and/or output terminal to be respectively coupled to or uncoupled from said input and/or output terminal of the electronic unit; and a protective element against electrostatic charges inserted on said transmission line between said at least first input and/or output terminal and said transmission gate.

2. The portable electronic instrument according to claim 1, wherein it further includes means for bringing said connecting element to a determined electric potential when said connecting element occupies said first position, and for interrupting the connection of said connecting element to said determined electric potential when said connecting element occupies said second position and thus allowing transmission of said electric signals on said transmission line.

3. The portable electronic instrument according to claim 1, wherein the transmitting or non-transmitting state of said transmission gate is controlled by a processor unit.

4. The portable electronic instrument according to claim 1, wherein it further includes a user interface for selecting the functions of said portable electronic instrument and wherein the transmitting or non-transmitting state of said transmission gate is selected via said user interface.

5. The portable electronic instrument according to claim 1, wherein it includes a user interface for selecting the functions of said portable electronic instrument, said user interface including at least a first control member mounted so as to be mobile on said case and able to be actuated by a user, said first control member also playing the part of said first input and/or output terminal.

6. The portable electronic instrument according to claim 5, wherein said control member is a push-button mounted so as to be mobile in an assembly orifice arranged in said case so as to have a translation travel along an axis of actuation, said push-button being able to be actuated by pressure to be brought from a first position called the non-pushed-in position to a second position called the pushed-in position, said push-button including an electrically conductive stem, forming said connecting element, which passes through said assembly orifice and which includes first and second ends extending respectively inside and outside said case.

7. The portable electronic instrument according to claim 5, wherein said control member actuates:

a first electric contact electrically insulated from said connecting element, for generating in response a control signal; and a second electric contact for establishing, in the pushed-in position, an electric connection between said connecting element and said transmission line, said second electric contact establishing, in said first position, an electric connection between said connecting element and a determined electric potential thus preventing the accumulation of electric charges on said connecting element.

8. The portable electronic instrument according to claim 1, wherein said electronic unit is coupled to a bus, and wherein said transmission line and said input and/or output terminal of said electronic unit are coupled to a line of said bus.

9. The portable electronic instrument according to claim 8, wherein said line of the bus is brought, in the unoccupied state, to a reference voltage, first means for pulling said bus line up to said reference voltage being connected to the bus line, between said transmission gate and said input and/or output terminal of the electronic unit, second means for pulling said bus line up to said reference voltage being connected to the transmission line, between said input and/or output terminal and said transmission gate.

10. The portable electronic instrument according to claim 1, wherein it includes, in addition to the first input and/or output terminal, a second input and/or output terminal capable of being coupled to a second input and/or output terminal of the electronic unit via a second transmission line, the transmission lines of the first and second input and/or output terminals respectively for transmitting a clock signal and a data signal.

* * * * *